US009210518B2

(12) United States Patent
Zhang

(10) Patent No.: US 9,210,518 B2
(45) Date of Patent: Dec. 8, 2015

(54) METHOD AND APPARATUS FOR MICROPHONE MATCHING FOR WEARABLE DIRECTIONAL HEARING DEVICE USING WEARER'S OWN VOICE

(75) Inventor: Tao Zhang, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 250 days.

(21) Appl. No.: 13/251,358

(22) Filed: Oct. 3, 2011

(65) Prior Publication Data

US 2012/0230526 A1 Sep. 13, 2012

Related U.S. Application Data

(63) Continuation of application No. 11/857,306, filed on Sep. 18, 2007, now Pat. No. 8,031,881.

(51) Int. Cl.

| | |
|---|---|
| ***H04R 3/00*** | (2006.01) |
| ***H04R 25/00*** | (2006.01) |
| *H04R 29/00* | (2006.01) |

(52) U.S. Cl.

CPC ..... *H04R 25/407* (2013.01); *H04R 29/006* (2013.01)

(58) Field of Classification Search

CPC ..... H04R 25/407; H04R 29/006; H04R 1/10; H04R 2410/01; H04R 2410/05; H04R 2430/20; H04R 2430/25; H04R 3/005

USPC ..... 381/92, 93, 101, 122, 58, 71.11–71.13, 381/56, 57, 97, 98, 312–313, 355, 356; 704/246–250

See application file for complete search history.

(56) References Cited

U.S. PATENT DOCUMENTS

| | | | | |
|---|---|---|---|---|
| 5,473,684 | A * | 12/1995 | Bartlett et al. | 379/395 |
| 6,421,448 | B1 | 7/2002 | Arndt et al. | |
| 6,594,632 | B1 | 7/2003 | White | |
| 6,785,394 | B1 | 8/2004 | Olsen et al. | |
| 7,027,607 | B2 | 4/2006 | Pedersen et al. | |

(Continued)

FOREIGN PATENT DOCUMENTS

| | | | |
|---|---|---|---|
| DE | 19934724 | A1 | 4/2001 |
| EP | 0679044 | A2 | 10/1995 |

(Continued)

OTHER PUBLICATIONS

"U.S. Appl. No. 11/857,306, Notice of Allowance mailed Jul. 21, 2011", 9 pgs.

(Continued)

*Primary Examiner* — Lun-See Lao

(74) *Attorney, Agent, or Firm* — Schwegman Lundberg & Woessner, P.A.

(57) ABSTRACT

Method and apparatus for microphone matching for wearable directional hearing assistance devices are provided. An embodiment includes a method for matching at least a first microphone to a second microphone, using a user's voice from the user's mouth. The user's voice is processed as received by at least one microphone to determine a frequency profile associated with voice of the user. Intervals are detected where the user is speaking using the frequency profile. Variations in microphone reception between the first microphone and the second microphone are adaptively canceled during the intervals and when the first microphone and second microphone are in relatively constant spatial position with respect to the user's mouth.

10 Claims, 4 Drawing Sheets

(56) References Cited

U.S. PATENT DOCUMENTS

| | | | | |
|---|---|---|---|---|
| 7,110,562 | B1 * | 9/2006 | Feeley et al. | 381/322 |
| 7,430,299 | B2 | 9/2008 | Armstrong et al. | |
| 7,558,390 | B2 * | 7/2009 | Nielsen et al. | 381/103 |
| 8,031,881 | B2 * | 10/2011 | Zhang | 381/92 |
| 2001/0038699 | A1 | 11/2001 | Hou | |
| 2002/0034310 | A1 | 3/2002 | Hou | |
| 2002/0071582 | A1 | 6/2002 | Troelsen et al. | |
| 2003/0053646 | A1 | 3/2003 | Nielsen et al. | |
| 2003/0142836 | A1 | 7/2003 | Warren et al. | |
| 2004/0022397 | A1 | 2/2004 | Warren | |
| 2004/0057593 | A1 | 3/2004 | Pedersen et al. | |
| 2004/0081327 | A1 | 4/2004 | Jensen | |
| 2004/0190737 | A1 | 9/2004 | Kuhnel et al. | |
| 2004/0190739 | A1 | 9/2004 | Bachler et al. | |
| 2004/0228495 | A1 | 11/2004 | Arndt et al. | |
| 2007/0195968 | A1 * | 8/2007 | Jaber | 381/71.11 |
| 2007/0258597 | A1 * | 11/2007 | Rasmussen et al. | 381/26 |
| 2009/0010442 | A1 * | 1/2009 | Usher et al. | 381/57 |
| 2009/0074201 | A1 | 3/2009 | Zhang | |

FOREIGN PATENT DOCUMENTS

| | | | |
|---|---|---|---|
| EP | 1081985 | A2 | 3/2001 |
| EP | 1489883 | A2 | 12/2004 |
| EP | 2040486 | B1 | 1/2012 |
| WO | WO-9534983 | A1 | 12/1995 |
| WO | WO-2004025989 | A1 | 3/2004 |
| WO | WO-2006021555 | A1 | 3/2006 |

OTHER PUBLICATIONS

"U.S. Appl. No. 11/857,306, Notice of Allowance mailed Aug. 2, 2011", 9 pgs.

"European Application Serial No. 08253039.5, Extended European Search Report mailed Sep. 17, 2010", 7 pgs.

"European Application Serial No. 08253039.5, Response filed Apr. 19, 2011 to Extended European Search Report mailed Oct. 25, 2010", 10 pgs.

* cited by examiner

METHOD AND APPARATUS FOR MICROPHONE MATCHING FOR WEARABLE DIRECTIONAL HEARING DEVICE USING WEARER'S OWN VOICE

RELATED APPLICATION

This application is a continuation of and claims the benefit of priority under 35 U.S.C. §120 to U.S. patent application Ser. No. 11/857,306, filed on Sep. 18, 2007, which is incorporated by reference herein in its entirety.

TECHNICAL FIELD

This disclosure relates generally to hearing devices and in particular to directional hearing devices receiving signals from more than one microphone.

BACKGROUND

Hearing assistance devices may have one or more microphones. In examples where two or more microphones receive signals, it is possible to have significantly different microphone responses for each microphone. Such systems are referred to as having "unmatched" microphones. Microphone mismatch can degrade the directional performance of the receiving system. In particular, it can diminish the ability of a manufacturer to control the directional reception of the device. Adjustment at the time of manufacture is not always reliable, since microphone characteristics tend to change over time. Adjustment over the course of use of the hearing device can be problematic, since the sound environment in which adjustments are made can vary substantially.

Microphone mismatch can be particularly problematic in designs of wearable directional devices which have configurations known as "optimal first-order directional microphone designs." Such mismatches can affect microphone directionality and can result in degradation of the directionality index, especially at low frequencies.

At least three approaches to microphone mismatch have been attempted. One approach is to use only directional microphones with a single diaphragm to reduce mismatch. This approach is limited, since it can be difficult to implement in higher than first order designs. Another approach is to use a suboptimal design to reduce the effect of microphone mismatch. However, this approach naturally sacrifices performance for reliability and cannot tolerate substantial mismatches. Another approach is to use electronics to estimate and compensate for the mismatch using environmental sounds. However, this approach is susceptible to changes in environmental conditions.

Thus, there is a need in the art for improved method and apparatus for microphone matching for wearable directional hearing assistance devices. The resulting system should provide reliable adjustment as microphones change. The system should also provide adjustments which are reliable in a varying sound environment.

SUMMARY

The above-mentioned problems and others not expressly discussed herein are addressed by the present subject matter and will be understood by reading and studying this specification.

Disclosed herein, among other things, is an apparatus for processing sounds, including sounds from a user's mouth. According to an embodiment, the apparatus includes a first microphone to produce a first output signal and a second microphone to produce a second output signal. The apparatus also includes a first directional filter adapted to receive the first output signal and produce a first directional output signal. A digital signal processor is adapted to receive signals representative of the sounds from the user's mouth from at least one or more of the first and second microphones and to detect at least an average fundamental frequency of voice, or pitch output. A voice detection circuit is adapted to receive the second output signal and the pitch output and to produce a voice detection trigger. The apparatus further includes a mismatch filter adapted to receive and process the second output signal, the voice detection trigger, and an error signal, where the error signal is a difference between the first output signal and an output of the mismatch filter. A second directional filter is adapted to receive the matched output and produce a second directional output signal. A first summing circuit is adapted to receive the first directional output signal and the second directional output signal and to provide a summed directional output signal. In use, at least the first microphone and the second microphone are in relatively constant spatial position with respect to the user's mouth, according to various embodiments.

Disclosed herein, among other things, is a method for matching at least a first microphone to a second microphone, using a user's voice from the user's mouth. The user's voice is processed as received by at least one microphone to determine a frequency profile associated with voice of the user, according to various embodiments of the method. Intervals are detected where the user is speaking using the frequency profile, in various embodiments. Variations in microphone reception between the first microphone and the second microphone are adaptively canceled during the intervals and when the first microphone and second microphone are in relatively constant spatial position with respect to the user's mouth, according to various embodiments.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present invention relates to method and apparatus for a hearing assistance device which provides the ability to have a robust microphone matching system. Various embodiments of such a system are contemplated. In one embodiment, the system includes apparatus and method for detecting signal-to-noise ratio of the wearer's voice. In one application, the system is employed in a worn hearing assistance device which affords a relatively fixed spatial position of the hearing assistance device with respect to the wearer's mouth. For example, such a system may include a hearing aid. Some examples are in-the-ear hearing aids (ITE hearing aids), in-the-canal hearing aids (ITC hearing aids), completely-in-the canal hearing aids (CIC hearing aids), and behind-the-ear hearing aids (BTE hearing aids). All such systems exhibit a relatively fixed spatial position of the microphones worn with respect to the wearer's mouth. Thus, measurements of voice-to-noise ratio are relatively consistent. It is understood that other hearing assistance devices may be employed and the present subject matter is not limited to hearing aids.

Figure 1:
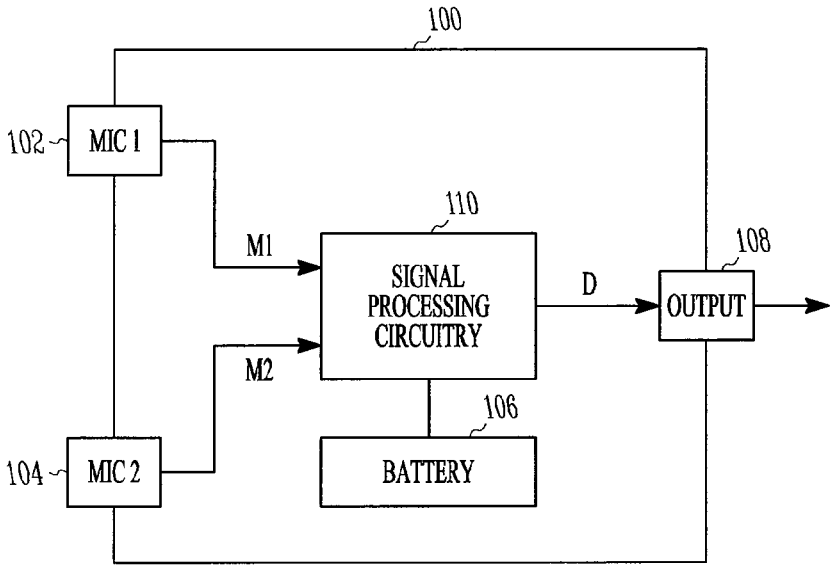
FIG. 1 shows a block diagram of a system for microphone matching for wearable directional hearing assistance devices, according to various embodiments of the present subject matter.

FIG. 1 shows a block diagram of a system for microphone matching for wearable directional hearing assistance devices, according to various embodiments of the present subject matter. The system 100 includes a first microphone 102 and a second microphone 104. While the diagram depicts microphone matching using two microphones, it will be apparent to those of skill in the art that any number of microphones can be matched using the system. Microphone outputs (M1, M2) are received by signal processing circuitry 110, such as apparatus 110 shown in FIG. 2, below. The signal processing circuitry 110 is powered by battery 106. According to various embodiments, battery 106 includes a rechargeable power source. After processing by circuitry 110, a directional output signal D is provided to output 108.

Figure 2:
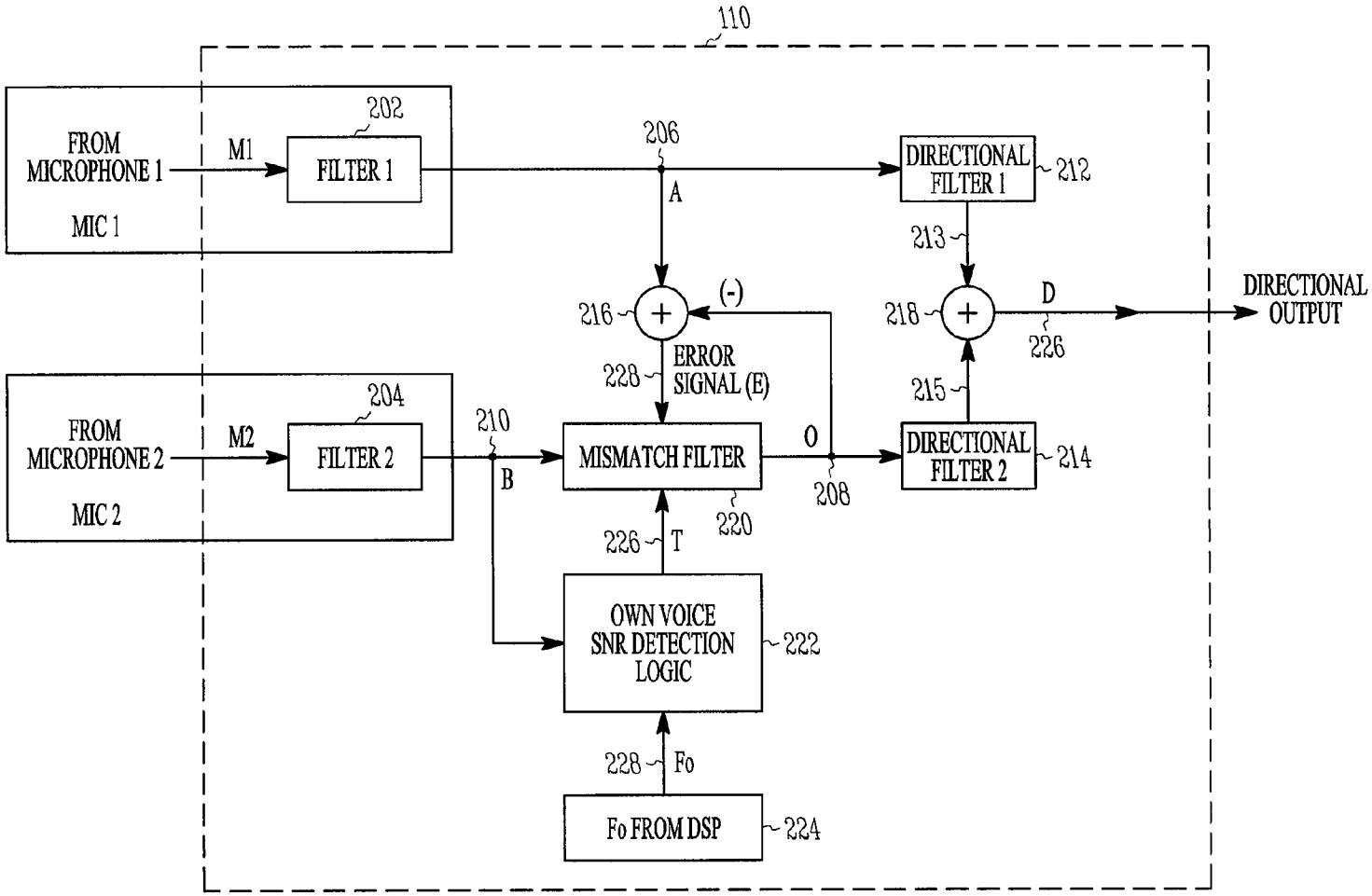
FIG. 2 shows an apparatus for processing sounds, including sounds from a user's mouth, according to various embodiments of the present subject matter.

FIG. 2 shows an apparatus 110 for processing sounds, including sounds from a user's mouth, according to various embodiments of the present subject matter. The apparatus 110 receives a set of signals from a number of microphones. As depicted, a first microphone (MIC 1) produces a first output signal A (206) from filter 202 and a second microphone (MIC 2) produces a second output signal B (210) from filter 204. The apparatus 110 includes a first directional filter 212 adapted to receive the first output signal A and produce a first directional output signal 213. A digital signal processor 224 is adapted to receive signals representative of the sounds from the user's mouth from at least one or more of the first and second microphones and to detect at least an average fundamental frequency of voice (pitch output) $F_o$ (228). A voice detection circuit 222 is adapted to receive the second output signal B and the pitch output $F_o$ and to produce an own voice detection trigger T (226). The apparatus further includes a mismatch filter 220 adapted to receive and process the second output signal B, the own voice detection trigger T, and an error signal E (228), where the error signal E is a difference between the first output signal A and an output O (208) of the mismatch filter. A second directional filter 214 is adapted to receive the matched output O and produce a second directional output signal 215. A first summing circuit 218 is adapted to receive the first directional output signal 213 and the second directional output signal 215 and to provide a summed directional output signal (D, 226). In use, at least the first microphone and the second microphone are in relatively constant spatial position with respect to the user's mouth, according to various embodiments.

According to various embodiments, the error signal E (228) is produced by a second summing circuit 216 adapted to subtract the output of the mismatch filter from the first output signal A (206). The mismatch filter 220 is an adaptive filter, such as an LMS adaptive filter, in various embodiments. According to an embodiment, the LMS adaptive mismatch filter includes a least mean squares processor (LMS processor) configured to receive the second output signal and the voice detection trigger and the error signal, and to provide a plurality of LMS coefficients, and a finite impulse response filter (FIR filter) configured to receive the plurality of LMS coefficients and the second output signal and adapted to produce the matched output.

According to various embodiments, the microphone matching system provided will match microphones in a number of different hearing assistance device configurations. Examples include, but are not limited to, embodiments where the first microphone and second microphone are mounted in a behind-the-ear hearing aid housing, an in-the-ear hearing aid housing, an in-the-canal hearing aid housing, or a completely-in-the-canal hearing aid housing. According to an embodiment, the apparatus is at least partially realized using a digital signal processor.

Figure 3:
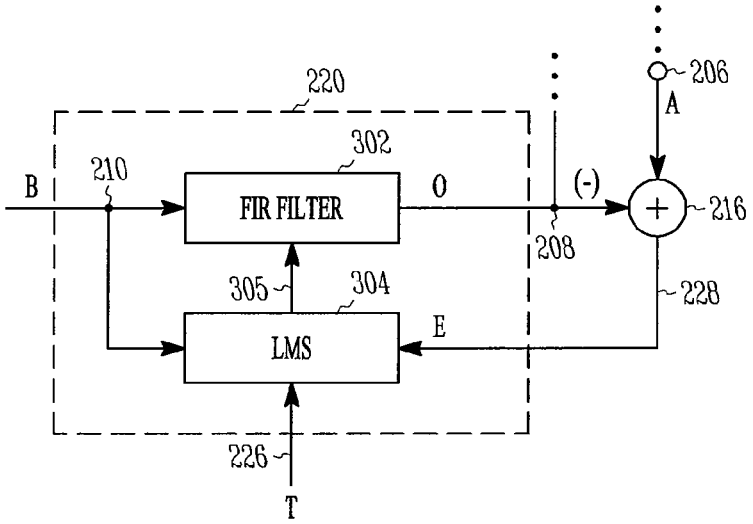
FIG. 3 shows a block diagram of a mismatch filter, such as illustrated in the apparatus of FIG. 2, according to various embodiments of the present subject matter.

FIG. 3 shows a block diagram of a mismatch filter such as illustrated in the apparatus of FIG. 2, according to various embodiments of the present subject matter. The mismatch filter 220 is an adaptive filter, such as an LMS adaptive filter, in various embodiments. According to an embodiment, the LMS adaptive mismatch filter includes a least mean squares processor (LMS processor, 304) configured to receive the second output signal B (210) and the voice detection trigger T (226) and the error signal E (228), and to provide a plurality of LMS coefficients 305. The LMS adaptive filter also includes a finite impulse response filter (FIR filter, 302) configured to receive the plurality of LMS coefficients 305 and the second output signal B (210) and adapted to produce the matched output O (228). According to various embodiments, the error signal E (228) is produced by a second summing circuit 216 adapted to subtract the output of the mismatch filter from the first output signal A (206).

Figure 4:
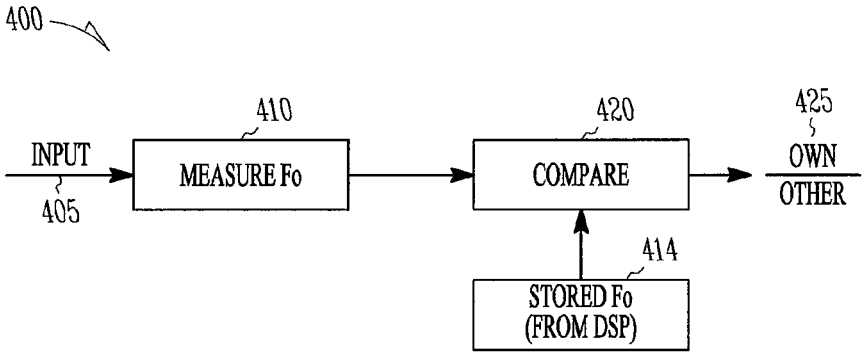
FIG. 4 shows a block diagram of a system for microphone matching, according to various embodiments of the present subject matter.

FIG. 4 shows a block diagram of a system for microphone matching, according to various embodiments of the present subject matter. The system 400 embodiment receives an input signal representative of the sounds from a user's mouth 405. From this input 405, processing is done using device 410 to measure an average fundamental frequency of voice (pitch output, $F_o$). The measured $F_o$ is compared, using comparator 420, with a stored $F_o$ 415 (from a device such as digital signal processor 224 in FIG. 2), and an output 425 is produced.

Figure 5:
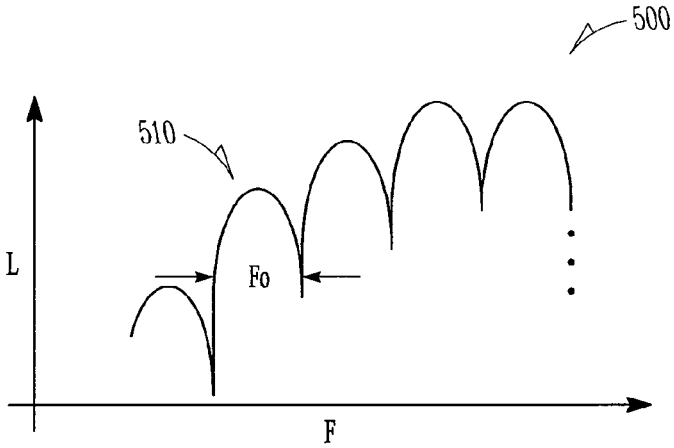
FIG. 5 shows a graphical diagram of an average fundamental frequency of a user's voice, according to various embodiments of the present subject matter.

FIG. 5 shows a graphical diagram 500 of an average fundamental frequency of a user's voice, according to various embodiments of the present subject matter. The apparatus depicted in FIG. 2 receives a set of signals from a number of microphones. A digital signal processor is adapted to receive signals representative of the sounds from the user's mouth from one or more of the microphones and to detect at least an average fundamental frequency of voice (pitch output) $F_o$ (510). According to an embodiment, a sampling frequency of over 10 kHz is used. A sampling frequency of 16 kHz is used in one embodiment.

Figure 6:
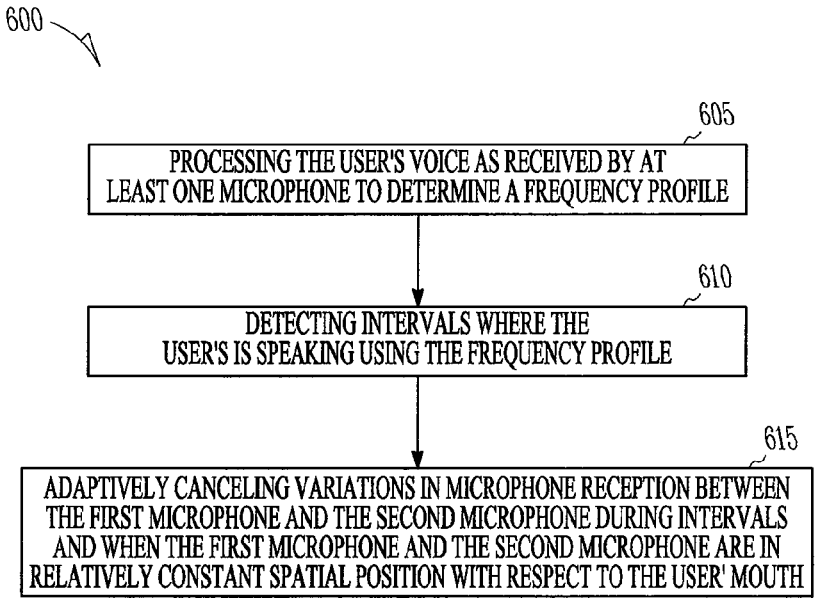
FIG. 6 shows a flow diagram of a method for matching at least a first microphone to a second microphone, using a user's voice from the user's mouth, according to various embodiments of the present subject matter.

FIG. 6 shows a flow diagram of a method 600 for matching at least a first microphone to a second microphone, using a user's voice from the user's mouth, according to various embodiments of the present subject matter. At 605, the user's voice is processed as received by at least one microphone to determine a frequency profile associated with voice of the user, according to various embodiments of the method. At 610, intervals are detected where the user is speaking using the frequency profile, in various embodiments. At 615, variations in microphone reception between the first microphone and the second microphone are adaptively canceled during the intervals and when the first microphone and second microphone are in relatively constant spatial position with respect to the user's mouth, according to various embodiments.

According to various embodiments, the processing is performed using voice received by the first microphone, by the second microphone or by the first and second microphone. Adaptively canceling variations includes an LMS filter adaptation process, according to an embodiment. According to various embodiments, the variations are adaptively canceled in a behind-the-ear hearing aid, an in-the-ear hearing aid, an in-the-canal hearing aid, or a completely-in-the-canal hearing aid. The variations are adaptively canceled using a digital signal processor realization, according to various embodiments.

The method of FIG. 6 compensates microphone mismatch in a wearable directional device, in various embodiments. The spatial locations of the microphones in the directional device are fixed relative to a user's mouth, so when the user speaks, any observed difference among matched microphones is fixed and can be predetermined, for example, using the fitting software by an audiologist in the clinic. Any additional difference observed among these microphones in practice is then due to microphone drift. A digital signal processor algorithm is designed to estimate this difference with the user is speaking, and compensates the directional processing in real-time, in varying embodiments. An advantage of this method is that it only depends on the user's own voice instead of environmental sounds, so the user has control of the timing of the compensation. In addition, the signal-to-noise ratio of the user's voice, when compared to environmental sounds, is usually high when the user is speaking According to an embodiment, a signal-to-noise ratio of at least 10 dB is typically observed. Thus, the compensation process can be activated whenever the user's voice is detected, which can be done using a signal processing method or a bone-conduction transducer, according to various embodiments. The method can be used not only for first-order directional devices, but also for higher-order directional devices in various embodiments.

It is understood that the examples provided herein are not restrictive and that other devices benefit from the present subject matter. For example, applications where matching of microphones not worn by a user will also benefit from the present subject matter. Other application and uses are possible without departing from the scope of the present subject matter.

This application is intended to cover adaptations or variations of the present subject matter. It is to be understood that the above description is intended to be illustrative, and not restrictive. Thus, the scope of the present subject matter is determined by the appended claims and their legal equivalents.

What is claimed is:

1. A method for matching a first and second microphone for a hearing assistance device worn by a user, the method comprising:

receiving signals representative of sounds from the user's mouth from at least one or more of the first and second microphones, the first and second microphones configured to be in relatively constant spatial position with respect to the user's mouth;

detecting an average fundamental frequency of voice, or pitch output, using the received signals;

producing a voice detection trigger based at least on the pitch output, the voice detection trigger configured to detect intervals when the user is speaking;

processing at least the voice detection trigger using a least means squares (LMS) adaptive filter to produce a mismatch output; and using the mismatch output to adaptively match directional microphone response of the first microphone to directional microphone response of the second microphone during the intervals.

2. The method of claim 1, wherein processing the voice detection trigger using an LMS adaptive filter includes using an LMS processor.

3. The method of claim 2, wherein processing the voice detection trigger using an LMS adaptive filter includes using a finite impulse response (FIR) filter.

4. The method of claim 3, comprising providing a plurality of LMS coefficients using the LMS processor.

5. The method of claim 4, comprising receiving the plurality of LMS coefficients and producing the matched output using the FIR filter.

6. The method of claim 1, comprising receiving signals representative of sounds from the user's mouth in a behind-the-ear hearing aid.

7. The method of claim 1, comprising receiving signals representative of sounds from the user's mouth in an in-the-ear hearing aid.

8. The method of claim 1, comprising receiving signals representative of sounds from the user's mouth in an in-the-canal hearing aid.

9. The method of claim 1, comprising receiving signals representative of sounds from the user's mouth in a completely-in-the-canal hearing aid.

10. The method of claim 1, wherein receiving signals representative of sounds from the user's mouth from at least one or more of the first and second microphones includes using a digital signal processor.

* * * * *